United States Patent [19]

Paul

[11] Patent Number: 5,074,670

[45] Date of Patent: Dec. 24, 1991

[54] BLENDER WITH FEED RATE CONTROL

[75] Inventor: Kermit D. Paul, Bethlehem, Pa.

[73] Assignee: Fuller Company

[21] Appl. No.: 522,435

[22] Filed: May 11, 1990

[51] Int. Cl.[5] ..... B01F 5/10; B01F 15/02

[52] U.S. Cl. ..... 366/101; 366/136; 366/159; 366/341

[58] Field of Search ..... 366/3, 9, 10, 14, 15, 366/101, 102, 103, 104, 106, 107, 136, 137, 159, 341

[56] References Cited

U.S. PATENT DOCUMENTS

| | | | |
|---|---|---|---|
| 4,375,335 | 3/1983 | Klein-Albenhausen | 366/15 |
| 4,398,828 | 8/1983 | Kluger et al. | 366/107 |
| 4,606,158 | 8/1986 | Krauss | 366/107 |
| 4,818,499 | 4/1989 | Chantriaux et al. . | |
| 4,834,544 | 5/1989 | Paul | 366/101 |
| 5,018,869 | 5/1991 | Paul | 366/101 |

FOREIGN PATENT DOCUMENTS

| | | | |
|---|---|---|---|
| 3808021 | 9/1989 | Fed. Rep. of Germany | 366/9 |

*Primary Examiner*—Philip R. Coe
*Assistant Examiner*—Tony Soohoo
*Attorney, Agent, or Firm*—Daniel De Joseph

[57] ABSTRACT

An integrated process blending apparatus which blends particulate material and is also adaptable to store blender inventory to thereby integrate process feed with the blending function. The apparatus comprises a fluidized bed blending means to preblend that raw feed which is not send directly to the gravity blender. Overflow from the fluidized bed means is directed into a storage chamber means from which it can be withdrawn upon demand and sent into the blender. The blender is also made more effective by dividing it into vertical compartments with separators which have angled portions preferably in their lower regions to cause different downward flow velocities in each compartment, and by creating a multistage blender by stacking sets of offset compartments one on top of another.

14 Claims, 5 Drawing Sheets

BLENDER WITH FEED RATE CONTROL

BACKGROUND OF THE INVENTION

This invention deals generally with a blender for solid particulate matter, and more specifically with a blender of the type which is a cylindrical vessel with a central lift column or pipe through which a gas is pumped to move material from the bottom to the top of the vessel for mixing.

Mineral feed to crushing equipment varies in chemical composition and in other critical properties such that there is a need for homogenizing the feeds to the downstream process. This is typically done by utilizing a blender means such as a particulate blender intermediate the crushing equipment and the downstream process.

Particulate blenders which are cylindrical vessels with a central lift pipe or column to raise inventory from the bottom of the blender to the top for mixing are well known in the art. They are available in versions which feed the new material into the vessel at either the bottom or the top of the vessel, and both types use a gas pumped up through the central pipe to lift material from the bottom to the top, which material is then moved by gravity to the bottom again through various deflector structures, which in certain prior art blenders consist generally of narrow flow passages which cause the material to be mixed.

Such blenders are used to primarily blend free flowing granular materials both in the batch and continuous mode. When non-free flowing materials such as certain powders are used, however, the customarily narrow internal blending passageways, tubes or channels can tend to become blocked and rendered ineffective. It would be desirable, therefore, to have a design which can function on non-free flowing materials in a blending mode with a high degree of energy efficiency.

In addition, in mineral processing applications equipment downstream of the blender, typically pyroprocessing equipment, will run at a higher level of availability than the mineral processing equipment, i.e., the crushers and mills, that are located upstream of the blender. Consequently, the designed throughput of "upstream" equipment must be considerably higher than that of "downstream" equipment. Therefore, there is a need to utilize, in conjunction with the blending equipment, a raw feed storage means in order to ensure a steady flow of material through the blender and thereafter to pyroprocessing equipment during those times when mineral processing equipment is not available. It would be desirable, therefore, to have a blending device that operates in conjunction with a feed storage means in an efficient manner.

These objectives are realized by providing a blender in which the internal volume is compartmentalized with large flow passage areas for the non-free flowing materials which are also designed to create differences in velocity and mixing as material passes through the blender. The blender of this invention is also adaptable to store and to internally recycle blender inventory in a manner such that the net flow to the subsequent downstream process can be controlled at a predetermined rate thereby integrating process feed with the blending function and, in addition, providing a means to control the process feed rate.

SUMMARY OF THE INVENTION

One element of this invention contemplates integrating the central lift pipe gravity blender into a continuous process by diverting excess raw feed material to a separate storage container after it has been mixed with previously blended material. This mixing occurs in a fluidized bed blender with which the storage container is interconnected and which preferably functions as an interim holding container for a mixture of blended and raw material that is added to the blender. The term fluidized bed blender is used in its art recognized sense to mean a container means through which aeration air permeates to thereby suspend any solid particles in the container in a fashion that causes the solid particle mass to exhibit characteristics of a fluid. Any mixing that takes place in such an blender is typical of a fluid type state of mixing.

The fluidized bed blender discharges flow, in a predetermined ratio, to both the top of the gravity blender and the preblended storage container. The gravity blender also receives a predetermined ratio of the raw feed that comes directly from the mineral preparation equipment. Any feed from said equipment that does not go directly to the blender will be diverted to the fluidized bed blender referred to above where it will preferably mix with preblended material which is diverted from the blender's lift pipe by a deflector means located in a continuation of the lift pipe. This serves to ensure that the fluidized bed blender will also contain a mixture of preblended and raw feed material. The manner in which material passes from the fluidized bed blender to the storage chamber will vary. Preferably, overflow from the fluidized bed blender that does not go directly to the gravity blender will pass, such as by gravity, into the preblended storage chamber. Material will pass from the preblended storage chamber to the lift pipe of the blender by conventional conveying means and only at such time when flow to the blender from the mineral preparation equipment is insufficient to meet downstream processing needs.

It is also an important aspect of this invention that the pressure that exists at the bottom of the fluidized bed blender is transmitted throughout the entire chamber of the gravity blender so each point in the gravity blender is at approximately the same pressure as the bottom of the fluidized bed. This increases the rate at which the materials will enter the lift pipe at the bottom of the blender and the conveying airstream therein.

The present invention preferably employs a deflector means to control the quality of material being removed from the blender and to be diverted to the fluidized bed means. This deflector is located within a continuation of the lift pipe of the blender. This deflector is deployed so as to permit a portion of the material moving up the lift pipe to be diverted into a material/air disengaging chamber. The deflector itself can be preset to be automatically controlled by a sensor means which can measure the actual total flow of material from the blender to the downstream process. The sensor can utilize any sensing means which can be suitably calculated to give the desired information. For instance, the sensing means can be a pressure sensing means whereby it will measure the pressure differential across a fixed length in the exit pipe located downstream of the deflector through which the material leaving the blender passes and thereby calculate the particle flow rate as a function of such measurement.

The invention also contemplates features within the blender itself which improve the blending action over the degree of blending which had previously been available. To attain this improved blending capability, vertical partitions are located within the gravity blending chamber to divide the vessel into two or more vertically oriented compartments which are sufficiently large to facilitate the passage of non-free flowing material therethrough. These partitions are oriented in an essentially vertical plane to permit the downward flow through the partitions of particulate material by gravity. Moreover, at least one, but not necessarily all of the partitions are further divided into at least two portions. These portions are all located in an essentially vertical plane but have different slopes to thereby create, in the two adjacent compartments having said divided partition in common, differences in cross-sectional flow areas.

The portions of the divided partition are oriented at angles to each other. Alternatively, rather than be divided into "portions", at least one partition can be in the form of a spiral having an infinite number of different slopes.

In the preferred embodiment of the invention, at least one partition in the blender is divided into portions, both of which are in a generally vertical orientation but constructed so that the lower portion is angled more off the vertical than the upper portion. This will result in different downward flow rates for material on opposite sides of the same partition, assuming every partition in the blender is not constructed in exactly the same fashion, and therefore increases the blending action, in that the mixing action of a lift pipe type blender is to some extent dependent on the existence within the vessel of multiple downward flow rates for the material. When diverse downward flow rates exist, the various parts of the material starting from the top of the blender at any one time will reach the bottom at different times. At the bottom, each part of the initial top layer will therefore be carried up by the lift pipe along with and mixed with material from other levels within the vessel with which it was not previously associated. Thus, the different downward flow rates contribute significantly to the mixing action.

Each compartment within the blender is therefore bounded by (1) two vertical partitions, (2) the outer surface of the lift pipe and (3) the inner surface of the shell of the blender. For example, in the preferred embodiment of the invention described above, the differences in velocity within each compartment within the blender can be pre-established by the ratio of the cross sectional areas immediately above and below the junction between the two portions of the partition plates. By way of example, if there are two adjacent compartments in the blender of the present invention that have equal cross sectional areas at the top of each compartment above the junction but different cross sectional areas beneath the junction at the bottom of the compartments, the compartment that has a greater cross sectional area at the bottom of the compartments will have a higher velocity through the entire length of the blender than the compartment that has the smaller cross-sectional area. Generally, if the compartments within the blender are kept constantly full of material, the ratio of the velocities between such compartments will be equal to the ratio of the cross sectional areas beneath the junction between the two portions.

Another means for improving the blending action is to stack two or more sets of partitions vertically one above another. In this multiple stage blender, each group of partitions is offset from the one above it. This essentially subjects the material to additional mixing action because, as material leaves the bottom of one set of partitions, it is split by the next lower set of partitions and mixed with other material which was previously flowing in another vertical compartment. The result is improved blending. Preferably at least one partition in each set of partitions will be constructed in a spiral fashion or divided into two portions as described above.

The invention therefore furnishes a blender which not only can be integrated into a continuous process providing feed control to a process as well as blending, but also provides a blender whose design furnishes more effective blending than had previously been available.

DETAILED DESCRIPTION OF THE INVENTION

Figure 1:
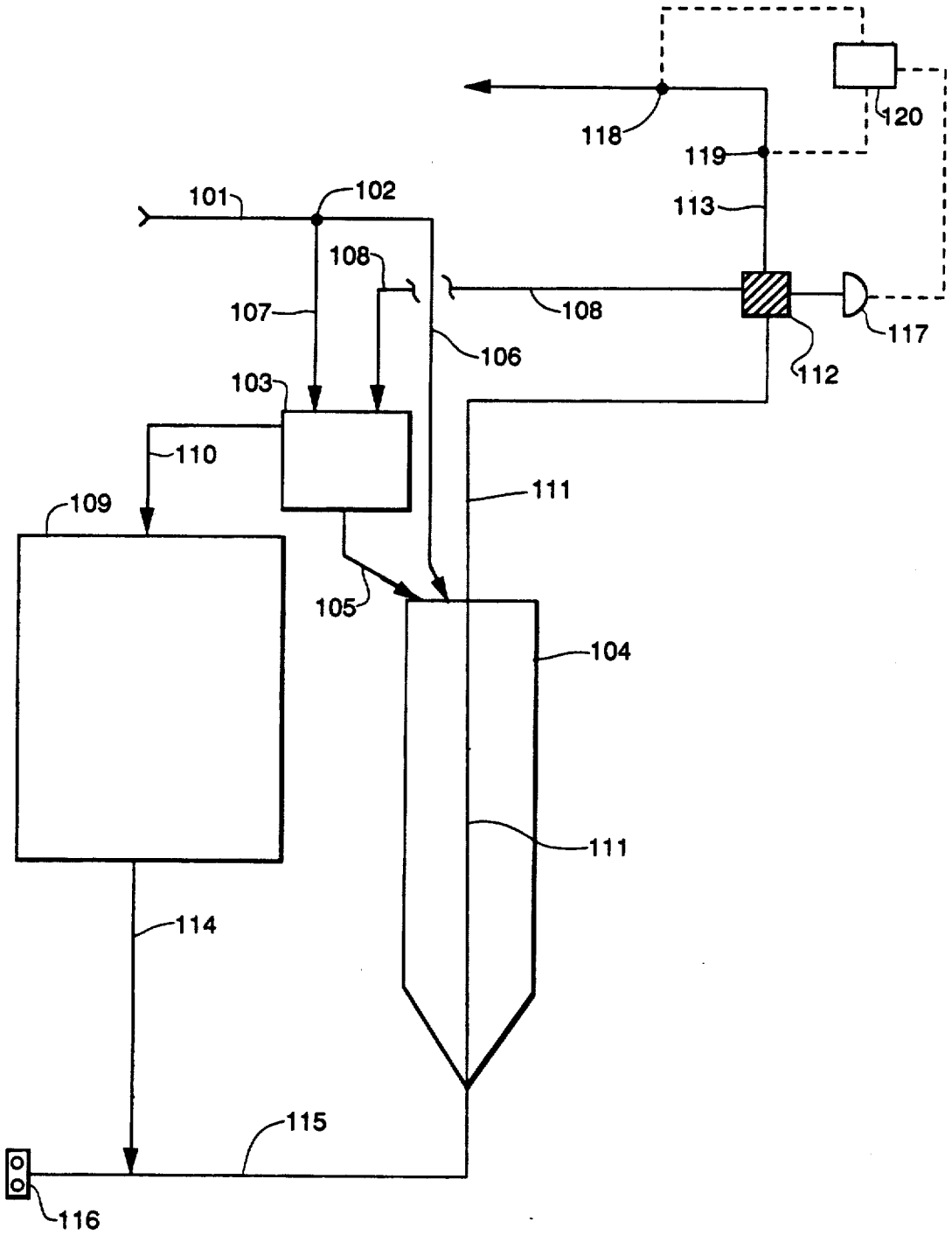
FIG. 1 is a simplified schematic drawing of the blending process of the present invention.

FIG. 1 is a simplified schematic diagram of the blending process of the invention.

Fresh feed produced in material processing means (not shown) is transported along conveying line 101 where, at junction 102 a predetermined amount is fed into fluidized bed mixing chamber 103 via conveying line 107 with the remainder going via conveying line 106 into gravity blender 104. From the fluidized bed mixing chamber 103 material will flow into the gravity blender 104 via passageway 105 in an amount that is at a predetermined ratio to the amount that enters the gravity blender 104 via conveying line 106. The fluidized bed 103 serves to homogenize both fresh feed passing therein via conveying line 107 and recycled blended material that enters via conveying line 108. Overflow material from fluidized bed 103 will pass, preferably by gravity, into storage chamber 109 via conveying line 110. The material will remain in storage chamber 109 until such time that the material processing means does not provide sufficient output to meet the needs of downstream processing equipment (not shown) from blender 104. The combined flow stream of conveying line 106 and passageway 105 that enters the gravity blender will travel down through blender 104 by gravity at the rate it is conveyed from the gravity blender 104 by lift pipe 111. The material will undergo mixing action as it moves downward through blender 104. At the bottom of gravity blender 104, the material is conveyed into lift pipe 111 via a conveying gas, delivered under pressure, that is fed into the blender through conveying line 115, which gas is fed from blower 116. The material then travels up through the blender in a gas stream via lift pipe 111. The material will continue through lift pipe 111 where it will encounter deflector 112. The function of deflector 112 is to divert any excess flow of material not required by the downstream process equipment.

This material will be diverted by deflector 112 to fluidized bed 103 via conveying line 108, where it will mix with fresh feed that is fed into fluidized bed 103 through conveying line 107. The feed not diverted will go to the downstream process equipment via exit pipe 113. At such time that feed is below requirements for the downstream process equipment, sufficient feed can be withdrawn through line 114 where it will encounter the gas stream and conveying line 115. The material will flow through conveying line 115 where it will meet with material flowing down through blender 104 and both will be conveyed up through lift pipe 111.

The position of deflector 112 is controllable by positioner 117, so that the amount of material recycled or forwarded to the downstream process can be varied by an operator, process controller or computer. For continuous feedback control of the feed of material to the downstream process it is also possible to measure the relative quantity of material leaving blender 104 through exit pipe 111. For one method of measuring the quantity of said material, it has been discovered that the pressure gradient in a vertically oriented conveying line is substantially proportional to the rate of material transfer within said line. Thus, gas pressure sensors 118 and 119 are attached at a location sufficiently remote from the entry to exit pipe 113 so that they react to the quantity of material flowing within exit pipe 113. Gas pressure sensors 118 and 119 are connected to controller means 120 which measures the pressure differential between the sensors spaced in accordance with the pre-established distance along the length of the pipe between sensor 118 and sensor 119, of exit pipe 113 and converts it to an indication of material flow by which to control positioner 117, which in turn controls deflector 112 to vary the quantity of material flowing in exit pipe 113.

Figure 2:
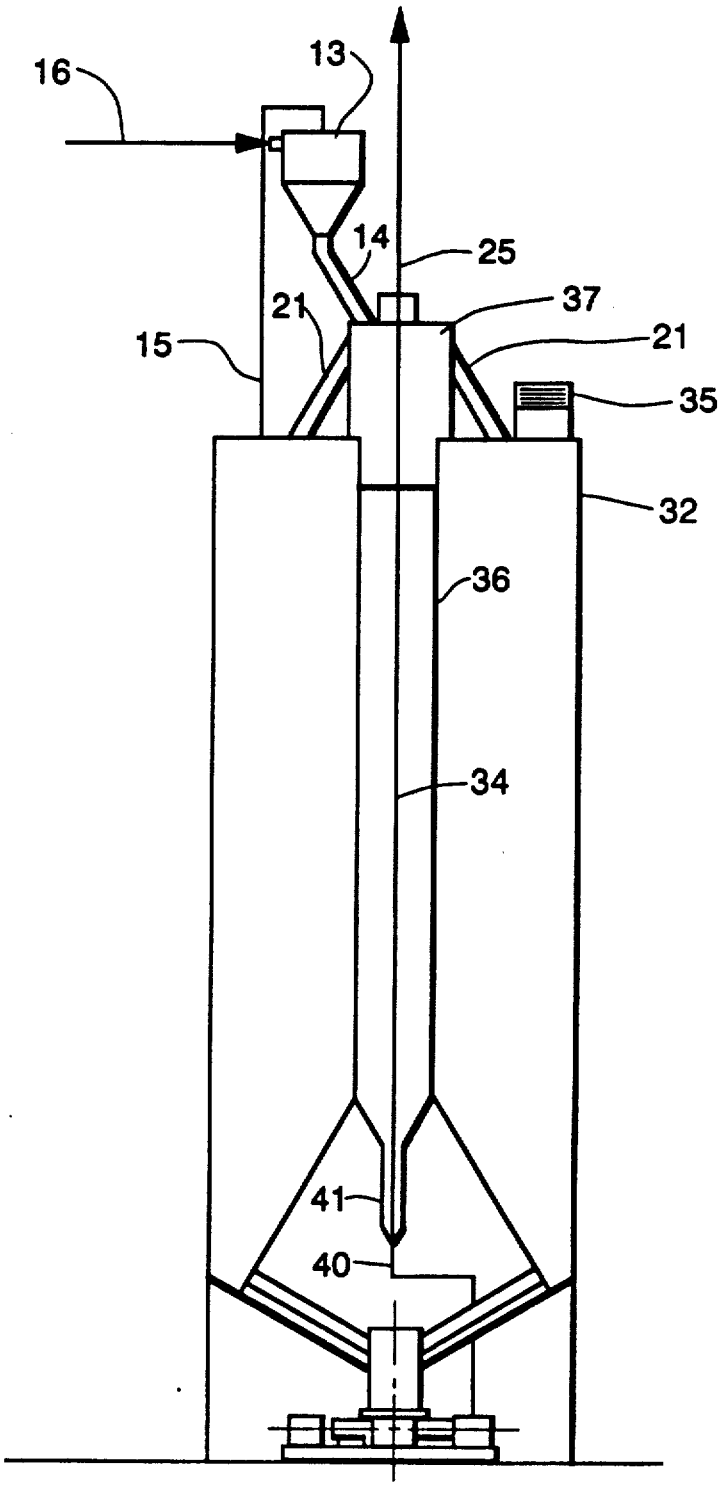
FIG. 2 is a more detailed schematic drawing of one element of the present invention.

FIG. 2 is a more detailed schematic depiction of the present invention, which shows a preferred embodiment of the present invention wherein the fluid bed blender 37 is located above gravity blender 36.

Blender 36 operates in somewhat conventional fashion in that blending gas is fed into the bottom of blender 36 through pipe 40, and the gas moves up lift pipe 34, taking with it material which has moved down in blender 36 to reach seal leg 41.

In one embodiment the practice of the present invention process material enters disengaging chamber 13 wherein the material is separated from the conveying gas stream with the material exiting in conveying line 14 and the air exiting to storage chamber 32 via conveying line 15. The gas is vented to atmosphere through filter 35. Excess material that enters fluid bed blender 37 flows via passageway 21 to storage chamber 32.

At such time that the feed to the blender is not sufficient to supply the demands of the downstream process devices, material must be extracted from storage chamber 32. This can be accomplished by conventional means. FIG. 2 illustrates one system wherein the extracted material is conveyed through air conveying passageway 40 into lift pipe 34 blender 37 in which it travels up through blender 37.

Figure 3:
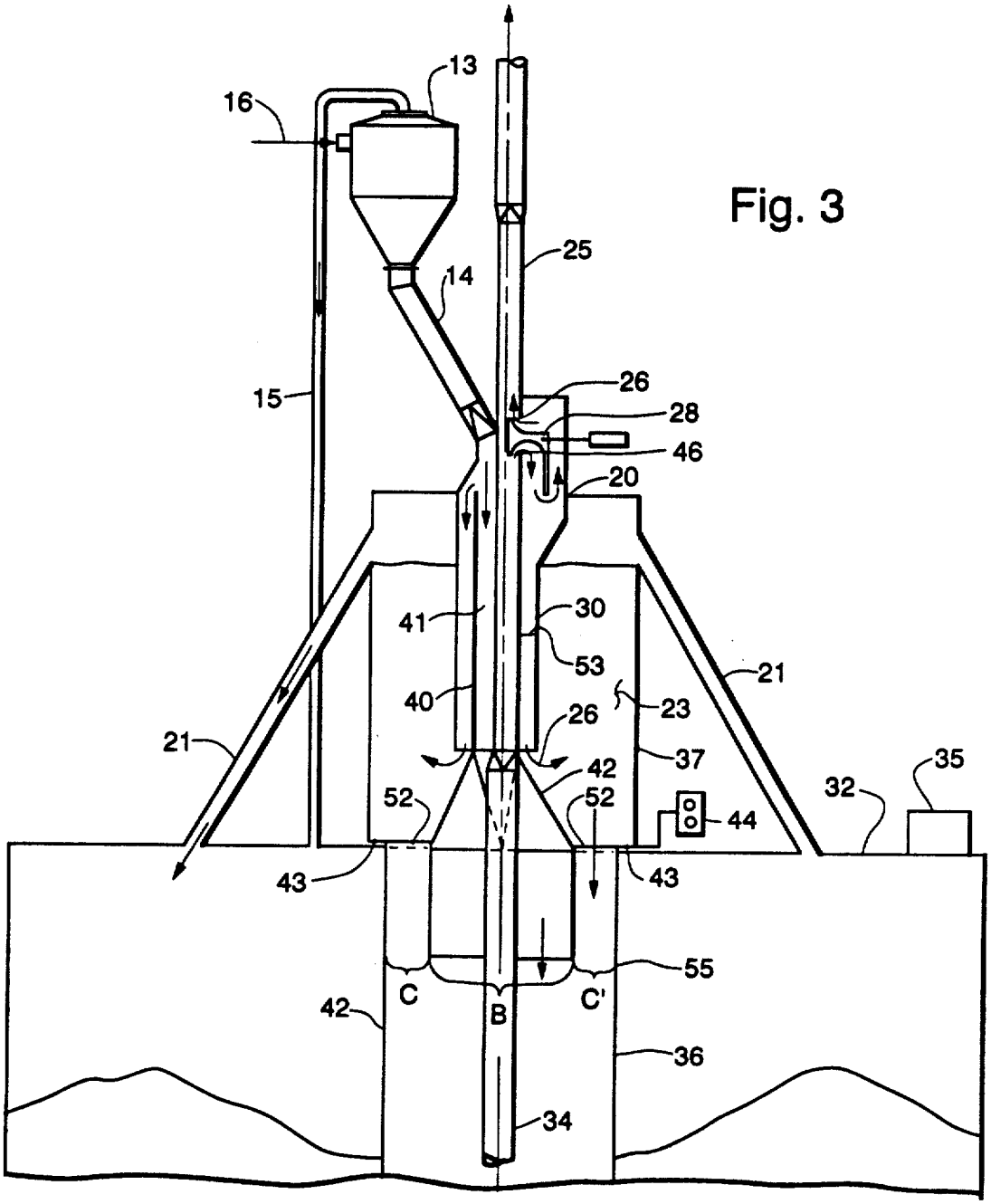
FIG. 3 is a detailed schematic drawing of another embodiment of the invention.

FIG. 3 is a more detailed schematic depiction of an alternate embodiment of the upper portion of FIG. 2.

In one embodiment of the present invention lift pipe 34 continues up to meet and join exit pipe 25. Moreover, deflector 28 is located within lift pipe 34 above fluid bed blender 37. The function of deflector 28 is to divert some of the gas and material moving up lift pipe 34 into disengaging chamber 20 whereupon it flows downward into spout 30 and into fluidized bed 37. This recycled material 26 enters fluid bed blender 37 where it is mixed with the inventory material 23 to form a homogenous mass, which is comprised of recycled material and a portion of the fresh feed.

Fresh feed material is conveyed via passage way 14 and is separated into two flow streams which are conveying passage ways 40 and 41. Flow that passes through passage way 41 is distributed across a predetermine portion of the cross-sectional area B of blender 36 by distribution hood 42. Any flow that is excess of that flow rate passes through passage way 40 into fluid bed blender 37 where it is a homogonized with inventory 23 and recycle flow 26. As indicated, distribution hood 42 can be of a pre-established area B relative to C and C'. The sum of areas of B, C and C' will equal the cross-sectional area of blender 36 at point 55.

Flow in excess of that which leaves blender 37 via exit pipe 25 relative to that which enters the blender 37 via conveying line 16 overflows from fluid bed blender 37 via conveying line 21 into storage chamber 32. The material exiting fluid bed 23 will flow either through passage way 21 to storage tank 32 or will flow out onto the top of the gravity blender by path 52.

With regard to gas moving up lift pipe 34 which is diverted by diverter 28 through first opening 46, said diverted gas, void of most of its material, will return, via second opening 26, to join the rest of the non-diverted gas and the material carried with it to proceed into and through exit pipe 25 to the subsequent process. Substantially all the gas which enters the bottom of lift pipe 34 will flow through exit pipe 25.

The material diverted, via first opening 46, into the top of blender falls onto the top surface 53 of passageway 30 and will eventually be transported by lift pipe 34 toward the top of blender 36, where it once more can move either into exit pipe 25 or back into blender 36. The gas that exited lift pipe 34 with the material being recycled reenters exit pipe 25 via second opening 26 again above deflector 28 and continues to aid the movement of the material in exit pipe 25.

Figure 4:
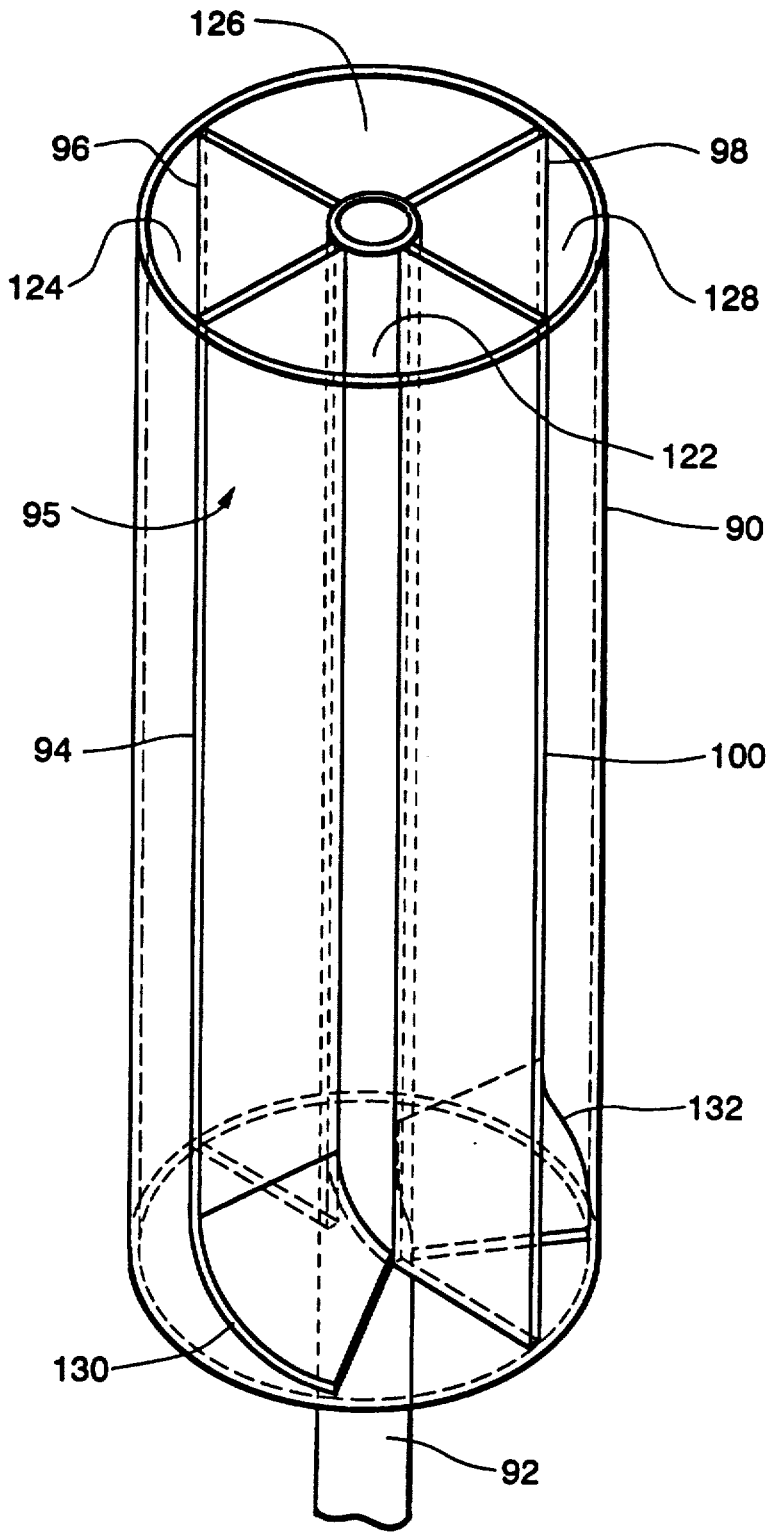
FIG. 4 is a partial cross section of an embodiment of the invention showing a vertical partition with an angled lower portion.

FIG. 4 shows a structural feature which is added to the lift pipe type blender of the present invention to improve its blending characteristics. For better clarity of illustration in FIG. 4, the outer walls of blender vessel 90 have been shown as if they were transparent and the vessel top has been omitted.

The embodiment of the invention shown in FIG. 4 includes conventional lift pipe 92, centrally located within blender vessel 90, with radial vertical partitions 94, 96, 98 and 100 oriented so that they form isolated compartments 122, 124, 126 and 128. It is preferred that the partitions are radial in the sense that they radiate out from the outer surface of lift pipe 92. However, it is understood that the partitions may be shaped in different fashions, as long as they serve to subdivide blender 90 into essentially vertical compartments. It is through these compartments that material lifted to the top of lift pipe 92 and thrown out at the top of the vessel moves downward, along with fresh feed fed to blender 89. It is understood that a blender according to this invention can have a different number of compartments than shown by FIG. 4. It is only necessary that a blender have two or more compartments.

Sloping panel or portion 130 of partition 94 provides blender 95 with more effective blending characteristics.

Whereas the upper portion of partition 94 above sloping panel 130 is in an essentially vertical plane, sloping panel 130, which is also in an essentially vertical plane to permit the passage of material through the compartment by gravity, is obviously offset more from the vertical plane than the upper portion 95 of partition 94. Panel 130 slopes into compartment 122, and therefore reduces the downward flow rate of material within that compartment by reducing the cross section of the flow area, relative to the flow area above the panel, in the lower part of the compartment. However, at the same time, the slope of panel 130 also increases the flow rate within compartment 124 by increasing the cross section flow area, relative to the flow area above the panel, in the lower region of that compartment. Panel 132, shown partially with phantom lines, has the same effects on compartments 128 and 126.

As discussed previously, effective blending depends essentially upon producing different downward flow rates within the blender, and by the simple device of sloping panels within a vessel, preferably in the lower region of a vertically divided vessel, the effectiveness of a blender can be considerably improved.

Figure 5:
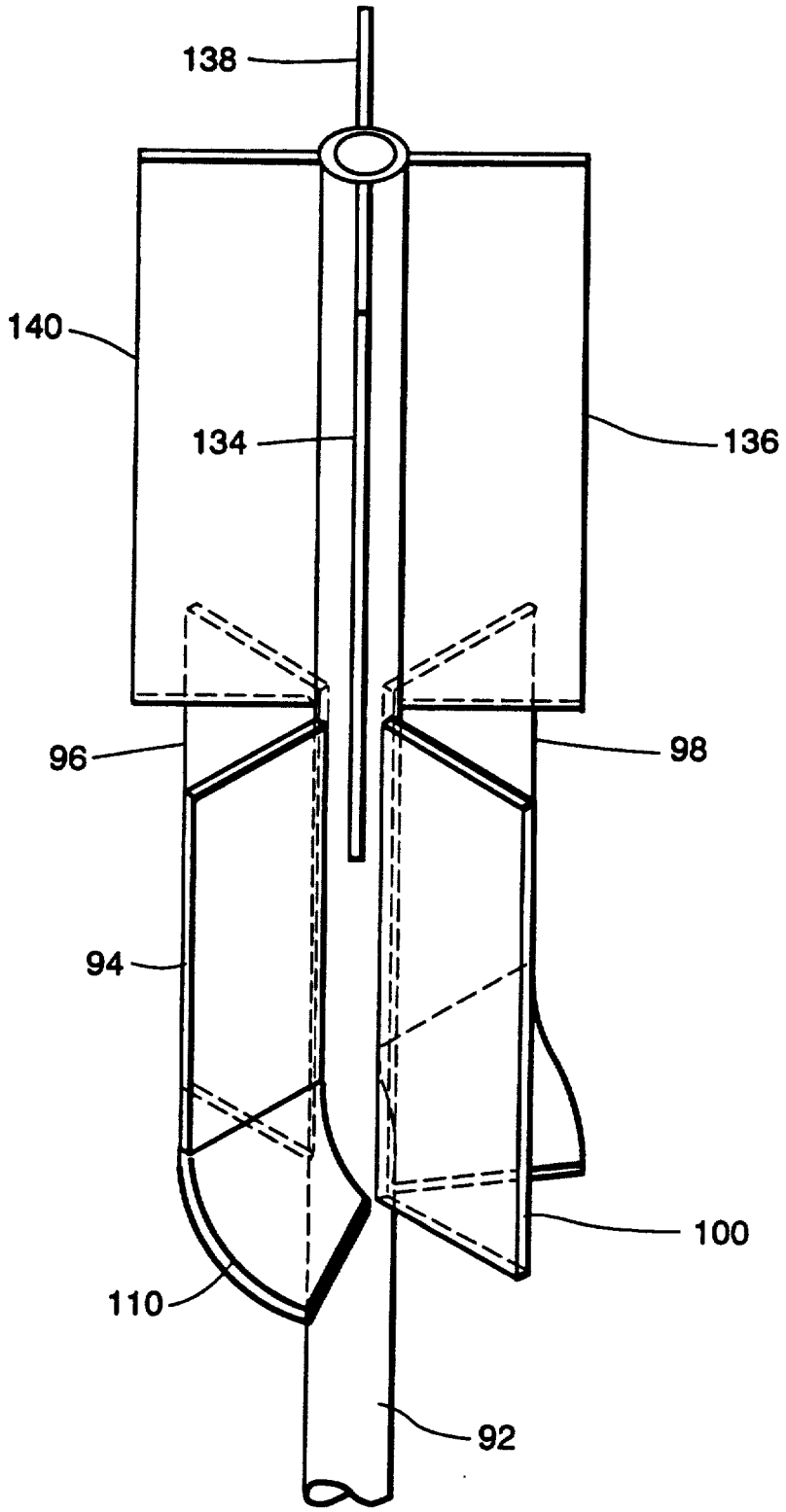
FIG. 5 is a partial cross section of an embodiment of the invention showing a two stage blender with offset partitions.

FIG. 5 shows an alternate embodiment of a blender constructed with compartments. For clarity in FIG. 5, the walls and top of the vessel of the blender are omitted. The embodiment of FIG. 5 essentially involves the addition of another set of partitions 134, 136, 138, and 140 above the set shown in FIG. 4. The partitions stacked above the lower set of partitions are, however, offset from the lower set, and not mere extensions of the lower partitions.

While partitions 134–140 are shown rotated around central lift pipe 92 relative to partitions 94–100, other configurations could also be used. For instance, parallel partitions might be used for the upper set, while radial partitions similar to those shown in FIG. 5 are used for the lower set. The essential criteria in this embodiment of the invention is that the adjacent sets of partitions be located so that an upper compartment feeds the material leaving at its bottom into more than one lower compartment. In that manner each junction between compartments causes an additional mixing action within the blender, because each lower compartment receives material from more than one upper compartment.

Although FIG. 5 shows a sloped panel 130 located at the bottom of the second set of partitions, i.e., partitions 94, 96 and 100, it is understood that there can be one or more sloping panels located at some point along the length of one or more of partitions 134, 136, 138 and 140 and preferably along the lower ends of each of the partitions leading into the second set of partitions, as further illustrated in FIG. 5.

It is to be understood that the form of this invention as shown is merely a preferred embodiment. Various changes may be made in the function an arrangement of parts; equivalent means may be substituted for those illustrated and described; and certain features may be used independently from others without departing from the spirit and scope of the invention as defined in the following claims.

What is claimed is:

1. In a particulate material blender of the type which includes a vertically oriented vessel with a top and a bottom, the vessel being constructed with an upper section which includes the top of the vessel, a source of pressurized gas attached to the vessel at a gas entry near the bottom of the vessel, a source of fresh feed for particulate material in fluid communication with the vessel, and a lift pipe supported within the vessel and extending from a location near the top of the vessel to a location above the gas entry, the improvement comprising:

a. a fluidized bed blender means located adjacent to the vessel and interconnected with:
   (i) the vessel to thereby introduce material from said fluidized bed blender means into said vessel;
   (ii) the source of fresh feed; and
   (iii) a storage bed means for receiving excess material from said fluidized bed blender means;

b. diverter means positioned to divert a predetermined portion of the fresh feed to the fluidized bed blender and the remaining portion of the fresh feed to the vessel; and c. withdrawal means for withdrawing material from the storage bed means and transferring said material to the vessel.

2. The blender of claim 1 further comprising:

a. an exit pipe attached to and extending above the lift pipe and out of the vessel;

b. a first opening in the lift pipe located within the lift pipe near the top of the vessel and above the top surface of the material within the vessel;

c. an adjustable deflector means located adjacent to the first opening in the lift pipe and shaped to divert a portion of the gas and material moving in the lift pipe into the exit pipe and a portion of the material moving in the lift pipe out of the lift pipe through the first opening into the fluidized bed blender means; and d. a second opening in the lift pipe located to permit gas to enter into the lift pipe from the region of the vessel which is above the top surfaces of the material within the vessel.

3. The blender of claim 2 further comprising a seal leg attached to the vessel near the bottom of the vessel.

4. The blender of claim 2 further including positioner means interconnected with and controlling the position of the adjustable deflector so as to vary the amount of the material that flows directly from the lift pipe into the exit pipe.

5. The blender of claim 4 further including sensor means associated with the exit pipe and interconnected with the positioner means, the sensor means measuring the quantity of material flowing in the exit pipe and controlling the positioner means based upon the quantity of material flowing in the exit pipe.

6. The blender of claim 5 wherein the sensor means comprise a pneumatic differential pressure measuring device.

7. The blender of claim 1 wherein the storage bed means transfers the material into the vessel at the gas entry.

8. The blender of claim 1 wherein the fluidized bed blender means is located directly on top of the vessel.

9. The blender of claim 1 further comprising a plurality of vertically oriented partitions within the blender, said partitions being of a sufficient number to divide the interior volume of the blender outside the lift pipe into at least two compartments which are essentially vertical to permit the downward flow therethrough of particulate material by gravity, where at least one partition in the blender is further divided into at least two portions, both of said portions being located in an essentially vertical position but oriented at angles to each other to thereby create, in the two adjacent compartments having a divided partition in common, differences their in cross sectional flow areas.

10. The blender of claim 9 wherein said partition has an essentially vertical upper portion and a lower portion which is oriented further away from the vertical plane and at an angle to the upper portion of the partition.

11. The blender of claim 10 further comprising a seal leg attached to the vessel near the bottom of the vessel.

12. In a particulate material blender of the type which includes a vertically oriented vessel with a top and a bottom, the vessel being constructed with an upper section which includes the top of the vessel, a source of pressurized gas attached to the vessel at a gas entry near the bottom of the vessel, a source of fresh feed for particulate material in fluid communication with the vessel, and a lift pipe supported within the vessel and extending from a location near the top of the vessel to a location above the gas entry, the improvement comprising:

a. a fluidized bed blender means located adjacent to the vessel and interconnected with:
   (i) the vessel to thereby introduce material from said fluidized bed blender means into said vessel;
   (ii) the source of fresh feed; and
   (iii) a storage bed means for receiving excess material from said fluidized bed blender means;

b. diverter means positioned to divert a predetermined portion of the fresh feed to the fluidized bed blender means and the remaining portion of the fresh feed to the vessel;

c. means for withdrawing material from the storage bed means and transferring said material to the vessel;

d. an exit pipe attached to and extending above the lift pipe and out of the vessel;

e. a first opening in the lift pipe located within the lift pipe near the top of the vessel and above the top surface of the material within the vessel;

f. an adjustable deflector located adjacent to the first opening in the lift pipe and shaped to divert a portion of the gas and material moving in the lift pipe into the exit pipe and a portion of the material moving in the lift pipe out of the lift pipe through the first opening into the fluidized bed blender means; and g. a second opening in the lift pipe located to permit gas to enter into the lift pipe from the region of the vessel which is above the top surface of the material within the vessel.

13. The blender of claim 12 further comprising at least two sets of at least two vertically oriented partitions which divide the interior volume of the blender outside the lift pipe into essentially vertical compartments, with one set of partitions being located above the other set of partitions, with the individual partitions in each set being offset from each other so that material moving in the compartments formed by the upper set of partition falls into more than one of the compartments formed by the lower set of partitions.

14. The blender of claim 12 further comprising a seal leg attached to the vessel near the bottom of the vessel.

* * * * *